US007485343B1

(12) United States Patent
Branson et al.

(10) Patent No.: US 7,485,343 B1
(45) Date of Patent: Feb. 3, 2009

(54) PREPARATION OF HYDROPHOBIC COATINGS

(75) Inventors: Eric D. Branson, Albuquerque, NM (US); Pratik B. Shah, Albuquerque, NM (US); Seema Singh, Rio Rancho, NM (US); C. Jeffrey Brinker, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 721 days.

(21) Appl. No.: 11/104,917

(22) Filed: Apr. 13, 2005

(51) Int. Cl.
*B05D 3/04* (2006.01)
*B05D 3/06* (2006.01)

(52) U.S. Cl. ..... 427/335; 427/553; 427/230; 427/337; 427/340

(58) Field of Classification Search ..... 427/335–344
See application file for complete search history.

(56) References Cited

U.S. PATENT DOCUMENTS

| | | | | |
|---|---|---|---|---|
| 5,948,482 | A | 9/1999 | Brinker et al. | |
| 6,258,305 | B1 | 7/2001 | Brinker et al. | |
| 6,291,022 | B1 * | 9/2001 | Hong et al. | 427/389.7 |
| 6,743,467 | B1 | 6/2004 | Jones et al. | |
| 6,756,217 | B1 * | 6/2004 | Dave et al. | 435/176 |
| 6,780,828 | B2 | 8/2004 | Nagy et al. | |
| 6,793,821 | B2 | 9/2004 | Lee et al. | |

* cited by examiner

*Primary Examiner*—Erma Cameron
(74) *Attorney, Agent, or Firm*—Elmer A. Klavetter

(57) ABSTRACT

A method for preparing a hydrophobic coating by preparing a precursor sol comprising a metal alkoxide, a solvent, a basic catalyst, a fluoroalkyl compound and water, depositing the precursor sol as a film onto a surface, such as a substrate or a pipe, heating, the film and exposing the film to a hydrophobic silane compound to form a hydrophobic coating with a contact angle greater than approximately 150°. The contact angle of the film can be controlled by exposure to ultraviolet radiation to reduce the contact angle and subsequent exposure to a hydrophobic silane compound to increase the contact angle.

14 Claims, 2 Drawing Sheets

PREPARATION OF HYDROPHOBIC COATINGS

This invention was made with Government support under Contract No. DE-AC04-94AL85000 awarded by the Department of Energy. The Government has certain rights in the invention.

BACKGROUND OF THE INVENTION

The invention describes a method for making a coating and, more particularly, to a method for making a hydrophobic coating.

It is well understood that the wettability of various materials is dependent on both the physical and chemical heterogeneity of the material. The notion of using the contact angle, θ, made by a droplet of liquid on a surface of a solid substrate as a quantitative measure of the wetting ability of the particular solid has also long been well understood. If the liquid spreads completely across the surface and forms a film, the contact angle, θ, is 0 degrees. If there is any degree of beading of the liquid on the surface of the substrate, the surface is considered to be non-wetting. For water, the substrate surface is usually considered to be hydrophobic if the contact angle is greater than 90 degrees. There are materials on which liquid droplets have high contact angles, such as water on paraffin, for which there is a contact angle of about 107 degrees. Many applications require a hydrophobic coating with a high contact angle of at least 150 degrees, and preferably at least 165 degrees. These coatings with such high contact angles are sometimes referred to as by super-hydrophobic.

The rolling of liquid droplets and the removal of foreign particles depend on both the hydrophobicity of the surface and on the surface roughness caused by different microstructures. The property of super-hydrophobicity has been observed on the petals and leaves of the lotus flower, hence the name "Lotus Effect". At very shallow angles of inclination or with the slightest wind, water droplets roll rather than flow. The rolling droplets entrain particle contaminants/parasites thereby cleaning them from the Lotus leaf surface. It is now recognized that the fascinating fluid behaviors observed for the Lotus plant, like the rolling and bouncing of liquid droplets and self-cleaning of particle contaminants, arise from a combination of the low interfacial energy and rough surface topography of waxy deposits covering their leaves. Because the Lotus-effect is solely based on the chemical and microstructural nature of the surface, it can potentially be mimicked to produce a self-cleaning surface. This self-cleaning property of materials can have various applications in bio-medical and microfluidic devices, protective layers for semiconductors, anti-corrosion coatings, and films on windows.

Directed motion of droplets is of interest in general to create containerless, surface-tension confined fluidic devices that are non-fouling, easy to clean, and allow transport of highly concentrated fluids with no loss to the walls. The potential to deliver highly concentrated fluid samples will overcome a major current obstacle in dielectrophoretic (DE) separations. The ability to coalesce drops also can provide the means to perform highly controlled reactions upstream of the fluidic analysis and has implications also for flow cytometry.

BRIEF DESCRIPTIONS OF THE DRAWINGS

DESCRIPTION OF SPECIFIC EMBODIMENTS

Low solid interfacial energy and fractally rough surface topography confer to Lotus plants superhydrophobic (SH) properties like high contact angles, rolling and bouncing of liquid droplets, and self-cleaning of particle contaminants. The method of the present invention exploits the porous fractal structure of a novel, synthetic SH surface for aerosol collection, its self-cleaning properties for particle concentration, and its slippery nature to enhance the performance of fluidic and MEMS devices. Using this method, liquid droplets can be caused to roll rather than flow/slide on a surface; this 'rolling transition' influences the boundary condition influencing fluid flow in a pipe or micro-channel. Rolling of droplets is important for aerosol collection strategies because it allows trapped particles to be concentrated and transported in liquid droplets with no need for a pre-defined/micromachined fluidic architecture. The fluid/solid boundary condition is important because it governs flow resistance and rheology and establishes the fluid velocity profile. Using the method of the present invention, increased flow/reduced friction, 2-600-cm/s slip velocities, approximately 0.75-mm slip-lengths, and transition to turbulent flow at higher Reynolds numbers has been observed.

In the method of the present invention, a hydrophobic coating is made by applying to a substrate by a coating method a precursor sol comprising a metal alkoxide, an alcohol, a basic catalyst, a fluoroalkyl compound, and water. The film layer formed by this precursor sol is heated to remove residual alcohol and then cooled. Surface derivatization is then accomplished by treatment with a hydrophobic silane compound, such as hexamethyldisilazane (HMDS) vapor. This produces a hydrophobic coating, generally with a contact angle greater than 150°, with contact angles of up to 170° achievable. The contact angles can be controlled using ultraviolet (UV)/ozone radiation. Exposure of the films to UV radiation can reduce the film contact angle, with an increase in contact angle again obtainable upon exposure to the vapor of the hydrophobic silane compound. These films can also be patterned to create optically defined regions, such as micro channels or even more complicated patterns and images. These patterns allow exposed areas to become hydrophilic while the covered areas remain hydrophobic. The level of patterning is limited only by the detail of the mask.

Surfaces coated with a super hydrophobic layer become self-cleaning. Water droplets have the ability to roll completely on top of the surfaces collecting any debris or impurities that have come to rest on the surface. A droplet captures the contaminant as it rolls over top of the surface and then can carries the contaminant to a hydrophilic patterned collection point or completely off the surface.

Figure 2:
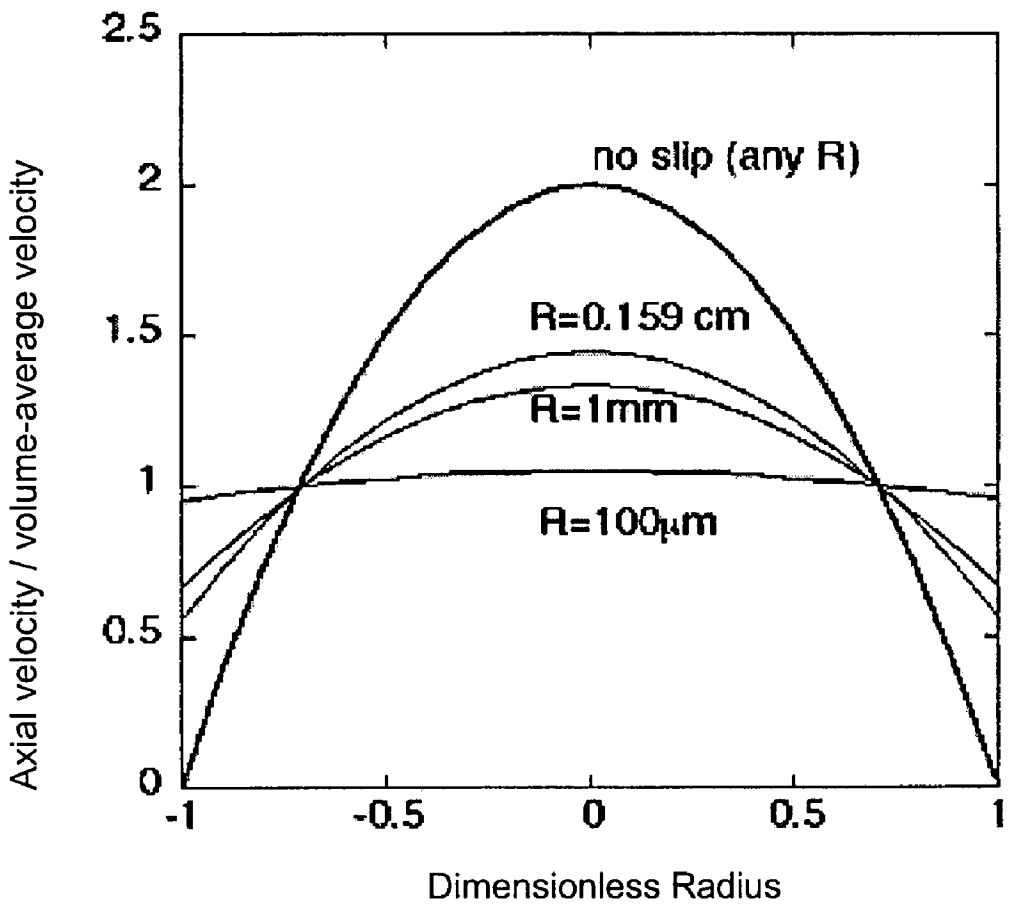
FIG. 2 shows flow velocity profiles for an uncoated tube and a tube coated with a hydrophobic coating.

In the method of the present invention, through surface derivatization of silica sols with fluoroalkyl groups, drying accompanying thin film deposition results in a hierarchical fractal surface decorated with hydrophobic ligand. Variation of the surface derivatization process allows tuning of both the film porosity and fractal dimension (as determined by small-angle x-ray scattering techniques). Applied to plastic, glass, silicon, and other substrates, these Lotus-like coatings are optically transparent with contact angles exceeding 150°. Water rolls ballistically on these surfaces at so-called 'sliding angles' less than 3°. When coated on the inside of 0.5-cm diameter poly(methyl methacrylate) tubing, an increased volumetric flow rate was measured compared to the uncoated tubing. By refractive index matching and using colloidal titania particles as tracers, the corresponding flow velocity profiles were determined under laminar flow conditions (Reynolds number=100-3000). As shown in FIG. 2, for the uncoated tube, a parabolic velocity profile with zero velocity at the wall (classic no-slip) was observed. However, for the coated tube, observed were 21-630-cm/s slip velocities and an approximately 0.75-mm slip length. Due to the appreciable slip velocity, the flow profile is more plug-like. The magnitude of observed slip is unprecedented (for example, self-assembled monolayers result in nm-scale slip lengths).

In the method of the present invention, the coating layer is a precursor sol that comprises a metal alkoxide, a solvent, a base catalyst, a fluoroalkyl compound, and water. The metal alkoxide can be tetramethyl orthosilicate (TMOS), $Si(OCH_3)_4$, tetraethyl orthosilicate (TEOS), $Si(OCH_2CH_3)_4$, titanium tetraisopropoxide, $Ti(O\text{-iso-}C_3H_7)_4$, titanium tetramethoxide, $Ti(OCH_3)_4$, titanium tetraethoxide, $Ti(OC_2H_5)_4$, titanium tetrabutoxide, $Ti(O(CH_2)_3CH_3)_4$, titanium iso-propoxide, $Ti(O(CH_2)_2CH_3)_4$, aluminum iso-propoxide, $Al(O(CH_2)_2CH_3)_3$, and zirconium n-butoxide, $Zr(O\text{-n-}C_4H_9)_4$ or mixtures thereof.

The solvent can comprise an alcohol such as methanol, ethanol, isopropanol, or butanol. Alternatively, the solvent can comprise other short chain alkyl compounds such as alkanes such as hexane or more polar compounds such as diethyl ether. The base catalyst is a liquid that can be used as a catalyst and that will provide a pH greater than neutral. A common base catalyst is ammonium hydroxide but other similar bases can be used such as sodium hydroxide or potassium hydroxide. In general any hydroxide or amine or ammonia related compound could be used to achieve the proper pH range.

The layers can be coated on various substrates, such as glass. Si-wafers, polyester films, fabrics, metals, and plastics. All the coated substrates showed super-hydrophobic phenomena. The processing is generally performed at standard temperature and pressure, except for the specified heating steps. As an alternative to dip-coating, spin coating or aerosol assisted methods can be used to make the layered films. In general, deposition of the layers can be performed by any suitable evaporative coating operation such as dip-coating or drainage, spin-coating, Mayer rod coating, slot coating and other liquid-to-solid coating operations familiar to practitioners of the art.

In the method of the present invention, either a single layer can be deposited on a substrate or multiple layers. The second, or additional, layer(s) also comprise a precursor sol comprising a metal alkoxide, an alcohol, a base, a fluoroalkyl compound, and water. Superhydrophobicity comes from both chemistry and roughness. By using the fluoroalkyl compounds, the material has fluorine-terminated long chains that impart Teflon-like hydrophobic nature, but this a smoother film. The TMOS layer gives additional roughness. In one embodiment, using a trifluoropropyl-trimethoxysilane (TFPTMOS) doped at certain levels (1% to 15% fluoroalkylsilane in TMOS, molar ratio) allows for both the chemistry and roughness contributions to hydrophobicity to be achieved in one coat. After a first layer is applied, the deposited film layer can be heated to remove residual alcohol and then cooled. The second layer can then be applied and heated, after which surface derivatization with a hydrophobic silane occurs.

Exposure of the deposited films to UV radiation can reduce the film contact angle by forming ozone which replaces alkyl groups with hydroxyl groups that results in a decrease in the surface contact angle. The contact angle can then be increased by re-exposure to the hydrophobic silane vapor. Using this process, the contact angle of the result film can thus be controlled.

In one embodiment, hydrophobic coatings are made using a double layer dip-coating method. Layer one is applied to a substrate using a metal alkoxide/alcohol/ammonium hydroxide/fluoro alkyl compound/water sol. The films are heated to remove residual alcohol and then cooled. The second layer is applied with a second sol comprising a metal alkoxide/alcohol/ammonium hydroxide/water mixture and reheated. Layers can optionally be washed with a solvent. Surface derivatization is then accomplished by treatment with hexamethyldisilazane vapor at elevated temperature. The contact angles can be controlled using ultraviolet (UV)/ozone radiation. Exposure of the films to UV radiation can reduce the film contact angle, with an increase in contact angle again obtainable upon exposure to HMDS vapor. These films can also be patterned to create optically defined regions, such as micro channels or even more complicated patterns and images. These patterns allow exposed areas to become hydrophilic while the covered areas remain hydrophobic. The level of patterning is limited only by the detail of the mask.

In one embodiment, a first layer is applied to a substrate using a tetramethyl-orthosilicate (TMOS)/methanol (MeOH)/ammonium hydroxide ($NH_4OH$)/trifluoropropyl-trimethoxysilane (TFPTMOS)/distilled water ($H_2O$) sol. The film is then heated to an elevated temperature, such as 100° C. or more, for such time to remove residual alcohol (approximately 15 minutes is adequate) and then cooled. At room temperature, a second layer is applied by dip-coating with a second sol comprising TMOS/MeOH/$NH_4OH$/$H_2O$ and reheated, again to approximately 100° C. for 15 minutes. Surface derivation is then achieved by treatment with HMDS (hexamethyldisilazane) vapor for five minutes at 180° C. This treatment is done to replace the hydrophilic hydroxyl groups with methyl groups to make the surface super hydrophobic. Using this method with these constituents, contact angles of up to 170 degrees have been achieved, but consistently reach at least 160 degrees. The refractive index for layer one has averaged 1.15, while layer two has averaged 1.09. Atomic Force Microscopy has shown an RMS value of approximately 34 nm, with an $R_{max}$ equal to 295.7 nm and a surface area close to 5,000 $\mu m^2$/2500 $\mu m^2$. Film thicknesses have achieved two microns.

Figure 1:
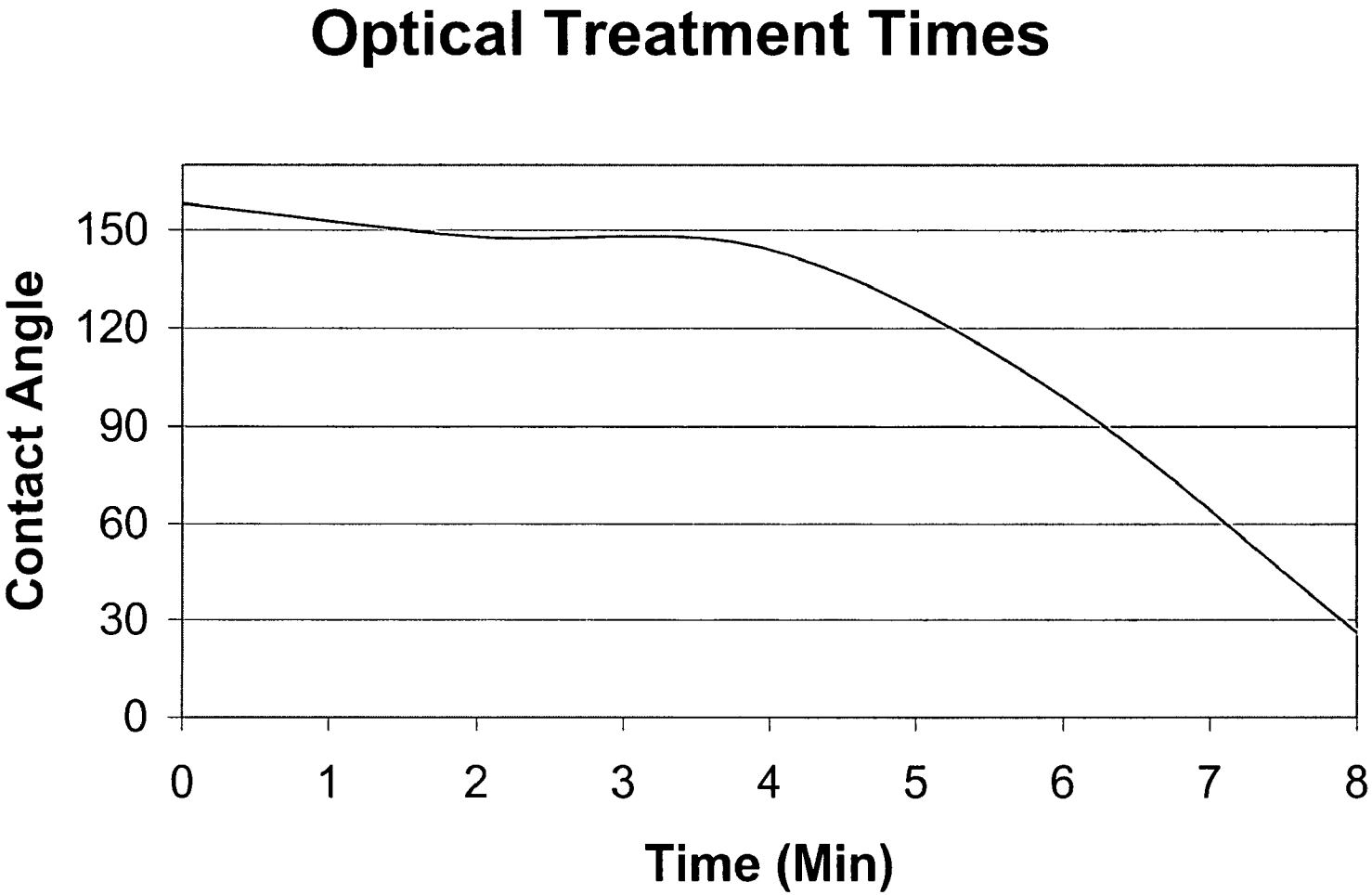
FIG. 1 shows the variation of contact angle of one embodiment of a hydrophobic coating with ultraviolet exposure time.

An uncoated mercury grid lamp was utilized to UV/Ozone treat these super hydrophobic aerogel coatings on silica wafers to control contact angles between 160 and 15 degrees. FIG. 1 shows the contact angles versus exposure time to the UV lamp.

Films showing low contact angles after UV/Ozone treatment were then re-treated with HMDS vapors to increase contact angles back up to 150 degrees or more, almost entirely regaining the water repelling tendencies of the original super hydrophobic films. These optical treatments can vary the contact angle from 160° to 15°. The maximum required treatment time is approximately eight minutes. In one embodiment, films that showed contact angles of 20° after treatment were then re-treated with HMDS vapors and the contact angles increased up to 150°, almost entirely regaining their water repelling tendencies. These films can be patterned to create optically defined regions, such as micro channels up to more complicated patterns and images.

In another embodiment, the hydrophobic coatings according to the present invention have also been used to coat the inside of pipes resulting in a phenomenon that appears to break boundary condition rules governing fluid flow. The interface between the pipe, which has been coated with a super hydrophobic coating and the flowing fluid, exhibits a frictionless effect that causes the fluid to roll at the interface, instead of the traditional no-slip conditions, allowing fluid velocities to remain constant throughout.

EXAMPLES

Example 1

Preparation of Hydrophobic Material with Multiple Layers

In the lab a sol mixture of tetramethylorthosilicate (TMOS)/methanol/ammonium hydroxide/trifluoropropyl-trimethoxysilane/water was made with the following molar ratios: 1/41.56/0.0028/0.3288/5.845. A second sol was made with a mixture of TMOS/methanol/ammonium hydroxide/distilled water with the following molar ratios: 1/21.87/0.0019/9.456. Both sols were then aged in a 50° C. oven for 96 hours. After aging, the sol was placed through a series of solvent exchanges: 3 ethanol washes over 3 hours, 2 hexane washes over 3 hours, 1 hexane with 5% hexamethyldisalizane (vol %) (HMDS) over 24 hours, 2 hexane washes over 2 hours, 2 ethanol washes over 2 hours. The gels were sonicated and centrifuged, then filtered through a 1 um filter to remove the large particulates. Dip coating was then done on a silica wafer for the first sol, followed immediately with a 15 min heating at 100° C. The second coat was dip-coated with the second sol two and followed immediately with heating at 180° C. in a hexamethyldisalizane vapor rich environment. After rinsing with distilled water, contact angle measurements were performed to get a value of approximately 164°.

Example 2

Coating of Sandstone and Adobe with the Hydrophobic Material

The sols made in Example 1 were taken out of a freezer and allowed to come to room temperature. When the sols reached room temperature, they were coated on a piece of sandstone and a piece of an adobe block using an air brush. The first sol was sprayed relatively thickly, while the second sol was applied moderately; a fifteen minute HMDS vapor treatment followed the second sol coating. Both the sandstone and adobe were then compared to uncoated pieces and showed excellent water repellent abilities. The uncoated and coated adobes were placed completely underwater. The uncoated block started disintegrating while the coated block was left untouched. Visible on the coated block under the water was an air layer that kept the water from contacting the block.

Example 3

Super Hydrophobic Silica Probes

Superhydrophobic probes for force microscopes (size ranging from 50 nm-1 mm) were prepared by first soaking monosized spheres in a TFPTMOS sol (constantly stirred on wheel for 2-4 hours). Next, TFPTMOS was exchanged with pure HMDS and allowed to react for 30 minutes at 80° C. The HMDS was carefully taken off the container and silica spheres were dried at 100° C. in the oven.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method for preparing a hydrophobic coating, comprising:

preparing a precursor sol comprising a metal alkoxide, a solvent, a basic catalyst, a fluoroalkyl compound and water;

depositing said precursor sol onto a surface as a film;

heating said film;

exposing said filmed to a hexamethyldisilazane vapor to form a hydrophobic coating with a contact angle greater than approximately 150°.

2. The method of claim 1 further comprising exposing said hydrophobic coating to ultraviolet radiation to decrease said contact angle.

3. The method of claim 1 further comprising exposing said hydrophobic coating to ultraviolet radiation to decrease said contact angle and subsequently exposing said film to a hexamethyldisilazane vapor to increase said contact angle.

4. The method of claim 1 wherein said surface is patterned to create optically defined regions.

5. The method of claim 1 wherein the surface comprises a material selected from the group consisting of a plastic, a polyester film, a fabric, glass, silicon, and metal.

6. The method of claim 1 wherein the metal alkoxide is selected from the group consisting of tetramethyl orthosilicate, tetraethyl orthosilcate, titanium teraisopropoxide, titanium tetramethoxide, titanium tetraethoxide, titanium tetrabutoxide, aluminum iso-propoxide, and zirconium n-butoxide.

7. The method of claim 1 wherein the solvent is selected from the group consisting of an alcohol, an alkane and an ether.

8. The method of claim 7 wherein the alcohol is selected from the group consisting of methanol, ethanol, isopropanol, and butanol.

9. The method of claim 1 wherein the basic catalyst is selected from the group consisting of a hydroxide, an amine or an ammonia compound.

10. The method of claim 9 wherein the hydroxide is selected from ammonium hydroxide and sodium hydroxide.

11. The method of claim 1 wherein depositing said precursor sol onto a surface is performed using a method selected from dip-coating, drainage, spin-coating, Mayer rod coating, and slot coating.

12. The method of claim 1 wherein the fluoroalkyl compound is trifluoropropyl-trimethoxysilane.

13. The method of claim 12 wherein the molar ratio of concentration of trifluoropropyl-trimethyoxysilane and metal alkoxide ranges from 0.01 to 0.15.

14. The method of claim 1 wherein said surface is the internal surface of a pipe.

* * * * *